US006991675B2

(12) United States Patent
Suda et al.

(10) Patent No.: US 6,991,675 B2
(45) Date of Patent: Jan. 31, 2006

(54) ELECTROLESS DISPLACEMENT GOLD PLATING SOLUTION AND ADDITIVE FOR USE IN PREPARING PLATING SOLUTION

(75) Inventors: Kazuyuki Suda, Saitama (JP); Yasushi Takizawa, Ageo (JP); Kazunori Hibi, Saitama (JP)

(73) Assignee: Shipley Company, L.L.C., Marlborough, MA (US)

( * ) Notice: Subject to any disclaimer, the term of this patent is extended or adjusted under 35 U.S.C. 154(b) by 277 days.

(21) Appl. No.: 10/362,386

(22) PCT Filed: Aug. 21, 2001

(86) PCT No.: PCT/JP01/07157

§ 371 (c)(1),
(2), (4) Date: Sep. 22, 2003

(87) PCT Pub. No.: WO02/16668

PCT Pub. Date: Feb. 28, 2002

(65) Prior Publication Data

US 2005/0031895 A1 Feb. 10, 2005

(30) Foreign Application Priority Data

Aug. 21, 2000 (JP) ..... 2000-249318

(51) Int. Cl.

| | |
|---|---|
| ***C23C 18/31*** | (2006.01) |
| ***C23C 18/48*** | (2006.01) |
| ***B05D 1/18*** | (2006.01) |
| ***B32B 15/01*** | (2006.01) |

(52) U.S. Cl. ..... 106/1.23; 106/1.26; 427/437; 428/336; 428/672

(58) Field of Classification Search ..... 106/1.23, 106/1.26; 427/437; 428/672, 336
See application file for complete search history.

(56) References Cited

U.S. PATENT DOCUMENTS

| | | | | | |
|---|---|---|---|---|---|
| 4,005,229 | A | * | 1/1977 | Miller et al. | 427/304 |
| 4,091,128 | A | * | 5/1978 | Franz et al. | 427/304 |
| 4,091,172 | A | * | 5/1978 | Miller | 428/630 |
| 5,645,628 | A | * | 7/1997 | Endo et al. | 106/1.23 |
| 5,955,141 | A | * | 9/1999 | Soutar et al. | 228/209 |
| 6,287,371 | B1 | * | 9/2001 | Ota et al. | 106/1.18 |
| 6,383,269 | B1 | * | 5/2002 | Toben et al. | 106/1.23 |
| 6,736,886 | B2 | * | 5/2004 | Suda et al. | 106/1.23 |
| 6,776,828 | B2 | * | 8/2004 | Kanzler et al. | 106/1.23 |
| 2003/0194485 | A1 | * | 10/2003 | Rhee et al. | 427/98 |
| 2004/0035316 | A1 | * | 2/2004 | Chebiam et al. | 106/1.22 |

FOREIGN PATENT DOCUMENTS

| | | | |
|---|---|---|---|
| EP | 1024211 | * | 8/2000 |
| WO | WO 00/28108 | * | 5/2000 |

* cited by examiner

*Primary Examiner*—Helene Klemanski
(74) *Attorney, Agent, or Firm*—S. Matthew Cairns; Peter F. Corless

(57) ABSTRACT

An object of the present invention is to provide an electroless displacement gold plating solution, an additive for use in preparing the plating solution, and a metal composite material obtained by treatment with the plating solution. The electroless displacement gold plating solution contains a water-soluble gold compound, a complexing agent, and a water-soluble silver compound, and optionally a water-soluble thallium compound, a water-soluble lead compound, a water-soluble copper compound or a water-soluble nickel compound, or any combination thereof. The plating solution has good stability and, even not only immediately after the preparation but also after a lapse of a certain time period from the preparation, can be used for production of a metal composite material exhibiting an even plated appearance and also having a thick gold coating film.

12 Claims, No Drawings

ELECTROLESS DISPLACEMENT GOLD PLATING SOLUTION AND ADDITIVE FOR USE IN PREPARING PLATING SOLUTION

TECHNICAL FIELD

The present invention relates to an electroless displacement gold plating solution, an additive for the plating solution, an electroless displacement gold plating method using the plating solution, and a metal composite material produced by the method. The present invention also relates to a method for stabilizing an electroless displacement gold plating solution by using the additive for the electroless displacement gold plating solution.

BACKGROUND ART

Gold plating is generally applied on the surfaces of electronic parts such as printed wiring boards, ceramic IC packages, ITO substrates, and IC cards, because of its physical properties such as the electric conductivity of gold, solderability, and jointability by thermocompression bonding, and its chemical properties such as oxidation resistance and chemical resistance. Many of these electronic parts need gold plating on electrically isolated sites. Therefore, for gold plating, an electroplating process is not applicable, but an electroless plating process is suitable.

Widely known conventional techniques for electroless gold plating include an electroless displacement gold plating process for depositing gold accompanied with dissolution of undercoat metal such as nickel and an autocatalytic gold plating process in which a reducing agent having catalytic activity acts on gold and makes it deposit. Now these two types are typical prevailing methods for electroless gold plating process.

In case of the electroless displacement gold plating process, the undercoat metal is displaced by gold deposition, and therefore the undercoat metal is dissolved (etched or eroded) as the gold is deposited. Particularly, when a thick-plated gold coating film is desired, the electroless displacement gold plating solution for thick-plating is used. In this case, the undercoat metal may severely be dissolved. This gives an adverse effect on the physical properties of the resulting gold coating film, such as adhesion, wire bondability, solder jointability, and solder wettability.

In order to prevent deterioration of physical properties of the coating, prior to thick electroless displacement gold plating, thin electroless displacement gold plating, and an undercoat plated coating film is formed on the undercoat metal to reduce the dissolution of the undercoat metal.

In this process, however, most of the undercoat metal surface is covered in the thin electroless displacement gold plating. Therefore, the undercoat metal can not be sufficiently dissolved in the thick electroless displacement gold plating, and the gold coating film can fail to reach the required thickness. Further, according to this process, the plated appearance may also be uneven in most cases.

In addition, as the thick electroless displacement gold plating, when the autocatalytic type electroless gold plating is used in which a reducing agent is made exist in a plating solution, the bath stability is poor, thereby causing many problems in practical use.

Accordingly, there has been a demand for development of an electroless displacement gold plating process that can provide a even plated appearance, a thick-plated coating, and good adhesion.

DISCLOSURE OF INVENTION

The present invention has been made in light of the situation as described above. An object of the present invention is to provide an electroless displacement gold plating solution that can form a gold plated coating film exhibiting a even plated appearance, being thick-plated and also having good adhesion to an undercoat metal with no adverse effect on its physical properties such as wire bondability, solder jointability and solder wettability, and to provide an electroless displacement gold plating method using the plating solution.

Another object of the present invention is to provide an additive for use in preparing the electroless displacement gold plating solution and a method for stabilizing an electroless displacement gold plating solution by adding the additive thereto.

The electroless displacement gold plating solution of the present invention is a plating solution containing a water-soluble gold compound, a complexing agent, and a water-soluble silver compound. Further, the plating solution may further contain a water-soluble thallium compound, a water-soluble lead compound, a water-soluble copper compound or a water-soluble nickel compound, or any combination thereof. An electroless displacement gold plating method for treating a metallic substrate with the electroless displacement gold plating solution, and a metal composite material having a metallic substrate with a metal coating formed thereon by the method of the above are also within the scope of the present invention.

Additionally, the additive for use in preparing the electroless displacement gold plating solution according to the present invention is constituted as an additive containing a water-soluble silver compound, a water-soluble thallium compound, a water-soluble lead compound, a water-soluble copper compound or a water-soluble nickel compound, or any combination thereof. The additive is added to an electroless displacement gold plating solution, thereby stabilizing the plating solution.

Best Mode for Carrying Out the Invention

An electroless displacement gold plating solution of the present invention contains a water-soluble gold compound, a complexing agent, and a water-soluble silver compound, which will be described in detail below.

The electroless displacement gold plating solution of the present invention is an aqueous solution containing a water-soluble gold compound, a complexing agent, and a water-soluble silver compound. Any grade of water can be used as water in the plating solution of the present invention, as far as it can achieve the object of the present invention. Examples of such water include but are not limited to distilled water, pure water, and ion-exchanged water. Any organic solvent can be contained in the electroless displacement gold plating solution of the present invention, as far as it can achieve the object of the present invention.

As the water-soluble gold compound for use in the electroless displacement gold plating solution of the present invention, any compound can be used as far as it is a material that is water-soluble, has a gold element, and has been used as a supply source of gold in the known gold plating solutions, but not limited thereto. Examples of the water-soluble gold compound include but are not limited to dicyanoaurates(I) such as sodium dicyanoaurate(I) and ammonium dicyanoaurate(I); tetracyanoaurates(III) such as potassium tetracyanoaurate(III), sodium tetracyanoaurate (III), and ammonium tetracyanoaurate(III); gold(I) cyanide; gold(III) cyanide; dichloroaurates(I); tetrachloro auric(III)

acid compounds such as tetrachloro auric(III) acid and sodium tetrachloroaurate(III); goldsulfites such as ammonium goldsulfite, potassium goldsulfite, and sodium goldsulfite; and gold oxide, gold hydroxide, and alkali metal salts thereof. Preferably, the water-soluble gold compound is potassium dicyanoaurate(I), potassium tetracyanoaurate (III), sodium tetrachloroaurate(III), ammonium goldsulfite, potassium goldsulfite, or sodium goldsulfite.

One type or a mixture of two or more types of the water-soluble gold compounds may be used. The content of the water-soluble gold compound in the electroless displacement gold plating solution of the invention is appropriately selected depending on the undercoat metal to be plated, the desired thickness of the gold coating film, the water-soluble silver compound and the water-soluble metal compound added to the plating solution, and the like. The water-soluble gold compound is generally contained in the plating solution in the range of from 0.0005 to 0.05 mol/liter as a gold element, preferably from 0.005 to 0.025 mol/liter, and more preferably from 0.01 to 0.02 mol/liter. When a content of the gold element in the plating solution is less than 0.0005 mol/liter, plating reaction is slow or hardly occurs. Even a gold element content of 0.05 mol/liter or more is not economical because of less cost effectiveness.

As the complexing agent for use in the electroless displacement gold plating solution of the invention, any compound can be used as far as it is a material that is water-soluble, can form a soluble complex with the gold element, and has been used for known gold plating solutions, but not limited thereto. The type of the complexing agent used in the invention is appropriately selected depending on the undercoat metal to be plated, the desired thickness of the gold coating film, water soluble gold compound, the water-soluble silver compound and the water-soluble metal compound contained in the plating solution, and the like. Preferably, examples of complexing agents include polyamines and salts thereof, animocarboxylic acids and salts thereof, oxycarboxylic acids and salts thereof, cyclic acid imide compounds, organic phosphonic acids and salts thereof, and inorganic phosphoric acids and salts thereof.

Examples of the polyamines include but are not limited to straight chain polyamines such as ethylenediamine, diethylenetriamine, diethylenetetramine, and triethylenetetramine; and cyclic polyamines such as piperazine, imidazolizine, and pyrazolidine. Examples of the salts thereof include but are not limited to sulfates, hydrochlorides, nitrates, and acetates.

Examples of the aminocarboxylic acids include but are not limited to glycine, iminodiarcetic acid, nitrilotriacetic acid, hydroxyethylethylenediaminetriacetic acid, tetrahydroxyethylenediamine, dihydroxymethylethylenediaminediacetic acid, ethylenediaminetetraacetic acid, cyclohexane-1,2-diaminetetraacetic acid, ethylene glycol diethyletherdiaminetetraacetic acid, ethylenediaminetetrapropionic acid, and N,N,N',N'-tetrabis-2-(2-hydroxypropyl) ethylenediamine. The salts thereof include but are not limited to alkali metal salts such as sodium salts and potassium salts, and ammonium salts.

The oxycarboxylic acids include but are not limited to tartaric acid, citric acid, gluconic acid, succinic acid, and malic acid. Further, the salts thereof include but are not limited to alkali metal salts such as sodium salts and potassium salts, and ammonium salts.

The cyclic acid imide compounds include the cyclic acid imide compounds having one or two nitrogen atoms in its molecular structure, including but not limited to succinimide, phthalic acid imide, hydantoin, and 5,5-dimethylhydantoin.

The organic phosphonic acids include the compounds having each of the structures represented by the formulae (I) to (III) each having a plurality of phosphonic acids in its molecule, and the salts thereof:

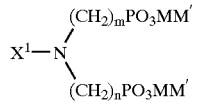

(I)

wherein $X^1$ is a hydrogen atom; a $C_1$ to $C_5$ alkyl group; an aryl group; an aryl alkyl group; an amino group; or $C_1$ to $C_5$ alkyl group substituted by a hydroxyl, a carboxyl (—COOH) or a phosphonic acid (—$PO_3MM'$) group, M and M' may be the same or different and are each selected from the group consisting of a hydrogen atom, sodium, potassium, and ammonium ($NH_4$), and m and n are each 0 or an integer of 1 to 5;

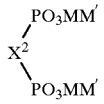

(II)

wherein $X^2$ is —$CH_2$—, —CH(OH)—, —$C(CH_3)$(OH)—, —CH(COOM)—, or —$C(CH_3)$ (COOM)—; and

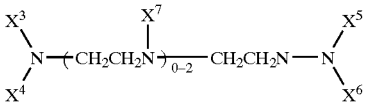

(III)

wherein $X^3$ to $X^7$ are each independently a hydrogen atom; a $C_1$ to $C_5$ alkyl group; an aryl group; an aryl alkyl group; an amino group; or $C_1$ to $C_5$ alkyl group substituted by a hydroxyl, a carboxyl (—COOH) or a phosphonic acid (—$PO_3H_2$) group, provided that at least two of $X^3$ to $X^7$ are a phosphonic acid group (—$PO_3H_2$), and m and n are each 0 or an integer of 1 to 5.

In the formulas (I) to (III), the $C_1$ to $C_5$ alkyl group may have a straight or branched chain, including, for example, a methyl group, an ethyl group, a propyl group, an isopropyl group, a butyl group, an isobutyl group, and a sec-butyl group. The aryl group may include, for example, a phenyl group and a naphthyl group. The aryl alkyl group may include any combination of the above alkyl group and the above aryl group.

Examples of the complexing agent having the structure of formula (III) include but are not limited to aminotrimethylenephosphonic acid, 1-hydroxyethylidene-1,1-diphosphonic acid, ethylenediaminetetramethylenephosphonic acid, diethylenetriaminepentamethylenephosphonic acid, or sodium, potassium or ammonium salts thereof.

The inorganic phosphoric acids include but are not limited to orthophosphoric acid, pyrophosphoric acid, and tripolyphosphoric acid. Further, the salts thereof include but are not limited to alkali salts such as sodium salts and potassium salts, and ammonium salts.

One type or a mixture of two or more types of the complexing agents may be used in the present invention. In the present invention, the amount of the complexing agent in the electroless displacement gold plating solution can be appropriately determined depending on the undercoat metal to be plated, the target thickness of the gold coating film, the water-soluble gold compound, the water-soluble silver compound and the water-soluble metal compound contained in the plating solution, and the like. The amount of the complexing agent in the plating solution is generally from 0.01 to 2.0 mol/liter, preferably from 0.1 to 1.0 mol/liter, more preferably from 0.5 to 0.7 mol/liter.

Any water-soluble, silver element-containing compound can be used as the water-soluble silver compound for use in the electroless displacement gold plating solution of the present invention. The type of the water-soluble silver compound used in the invention is appropriately selected depending on the undercoat metal to be plated, the desired thickness of the gold coating film, the water-soluble gold compound and the water-soluble metal compound contained in the plating solution, and the like. Preferred water-soluble silver compounds include but are not limited to potassium dicyanoargentate(I), silver oxide, silver nitrate, silver sulfate, and silver chloride.

The concentration of the water-soluble silver compound in the electroless displacement gold plating solution is in the range of from $1\times10^{-6}$ to $1\times10^{-3}$ mol/liter, preferably from $1\times10^{-5}$ to $1\times10^{-4}$ mol/liter, as a silver element.

One type or a mixture of two or more types of the water-soluble silver compounds may be used.

The electroless displacement gold plating solution of the invention can include another water-soluble metal compound containing a metal element other than a silver element and a gold element. Examples of the water-soluble metal compound include a water-soluble thallium compound, a water-soluble lead compound, a water-soluble copper compound, and a water-soluble nickel compound. The type and the amount of the water-soluble metal compound contained in the electroless displacement gold plating solution of the invention are appropriately determined depending on the undercoat metal to be plated, the desired thickness of the gold coating film, the water-soluble gold compound and other additives contained in the plating solution, and the like.

Any water-soluble, thallium element-containing compound as be used as the water-soluble thallium compound. Examples of the water-soluble thallium compound include but are not limited to thallium cyanide, thallium sulfate, thallium nitrate, thallium chloride, thallium carbonate, thallium hydroxide, and thallium oxide. Preferred water-soluble thallium compounds include thallium sulfate, thallium nitrate, and thallium chloride. Further, the amount of the water-soluble thallium compound in the electroless displacement gold plating solution of the invention is in the range of from $5\times10^{-6}$ to $2\times10^{-3}$ mol/liter, preferably from $5\times10^{-5}$ to $5\times10^{-4}$ mol/liter as a thallium element. Furthermore, the water-soluble thallium compound is contained in the plating solution such that, with respect to the silver element contained in the plating solution, a molar ratio of the silver element to the thallium element is in the range of from 1:2000 to 200:1, preferably from 1:50 to 2:1.

Any water-soluble, lead element-containing compound can be used as the water-soluble lead compound. Examples of the water-soluble lead compound include but are not limited to lead nitrate, lead hydroxide, lead chloride, lead phosphate, lead acetate, lead thiocyanate, and lead cyanide. Preferred water-soluble lead compounds include lead nitrate, lead hydroxide, and lead chloride. The amount of the water-soluble lead compound in the electroless displacement gold plating solution of the invention is in the range of from $5\times10^{-7}$ to $5\times10^{-4}$ mol/liter, preferably from $5\times10^{-6}$ to $5\times10^{-5}$ mol/liter, as a lead element. The water-soluble lead compound is contained in the plating solution such that, with respect to the silver element contained in the plating solution, a molar ratio of the silver element to the lead element is in the range of from 1:500 to 2000:1, preferably from 1:5 to 20:1.

Any water-soluble, copper element-containing compound can be used as the water-soluble copper compound. Examples of the water-soluble copper compound include but are not limited to copper sulfate, copper nitrate, copper chloride, copper bromide, copper oxide, copper hydroxide, and copper cyanide. Preferred water-soluble copper compounds include copper sulfate, copper nitrate, and copper chloride. Further, the amount of the water-soluble copper compound in the electroless displacement gold plating solution of the invention is in the range of from $2\times10^{-6}$ to $2\times10^{-3}$ mol/liter, preferably from $2\times10^{-5}$ to $2\times10^{-4}$ mol/liter, as a copper element. Furthermore, the water-soluble copper compound is contained in the plating solution such that, with respect to the silver element contained in the plating solution, a molar ratio of the silver element to the copper element is in the range of from 1:2000 to 500:1, preferably from 1:20 to 5:1.

Any water-soluble, nickel element-containing compound can be used as the water-soluble nickel compound. Examples of the water-soluble nickel compound include but are not limited to nickel sulfate, nickel nitrate, nickel chloride, nickel hydroxide, nickel oxide, nickel fluoride, and nickel bromide. Preferred water-soluble nickel compounds include nickel sulfate, nickel nitrate, and nickel chloride. Further, the amount of the water-soluble nickel compound in the electroless displacement gold plating solution of the invention is in the range of from $2\times10^{-5}$ to $2\times10^{-2}$ mol/liter, preferably from $2\times10^{-4}$ to $2\times10^{-3}$ mol/liter, as a nickel element. In addition, the water-soluble nickel compound is contained in the plating solution such that, with respect to the silver element contained in the plating solution, a molar ratio of the silver element to the nickel element is in the range of from 1:20000 to 50:1, preferably from 1:200 to 1:2.

One type or a mixture of two or more types of the water-soluble metal compounds may be used in the present invention. If two or more types of the water-soluble metal compounds are used, the metals contained in the respective water-soluble compounds may be the same or different.

The pH of the electroless displacement gold plating solution of the invention is appropriately adjusted depending on the undercoat metal to be plated, the desired thickness of the gold coating film, the water-soluble gold compound, the water-soluble silver compound and the water-soluble metal compound contained in the plating solution, and the like. From the view point of prevention of the deterioration of the undercoat metal, the pH is preferably 11 or below, more preferably 10 or below, and still more preferably 7 or below.

For the above-mentioned pH adjustment, any pH adjuster can be used, including water-soluble acids and water-soluble bases. Examples of the pH adjuster include but are not limited to sodium hydroxide, potassium hydroxide, ammonium hydroxide, sulfuric acid, sulfurous acid, hydrochloric acid, phosphoric acid, sulfamic acid, organic sulfonic acids, phosphonic acids, and carboxylic acids. Additionally, if necessary, any pH stabilizer may be added to the electroless displacement gold plating solution of the invention in order to suppress the fluctuation of the pH in the plating process. Applicable examples of the pH stabilizer include but are not limited to phosphates, phosphites, borates, and salts of carboxylic acids. The content of the pH stabilizer in the electroless displacement gold plating solution of the invention is appropriately determined depending on the pH of the plating solution and the other various compounds in the plating solution, and the concentration is generally from 0.01 to 2 mol/liter, preferably from 0.1 to 1 mol/liter.

For the purpose of improvement of the wettability on the metallic substrate to be plated, any wetting agent may be added to the electroless displacement gold plating solution of the invention. Various materials as far as they have been used for known gold plating processes can be used as the wetting agent, being not limited thereto. Examples of the wetting agent include but are not limited to nonionic surfactants such as polyoxyalkylene alkyl ether, polyoxyalkylene alkyl phenyl ether, polyoxyethylene polyoxypropylene glycol, fatty acid polyalkylene glycol, fatty acid polyalkylenesorbitans, and fatty acid alkanolamide; anionic surfactants such as aliphatic carboxylates, alkanesulfonates, alkylbenzensulfonates, alkylnaphthalenesulfonates, alkylsulfates, polyoxyalkylene alkyl ether sulfates, alkylphosphates, polyoxyalkylene alkyl ether phosphates, and polyoxyalkylene alkyl phenyl ether phosphates; cationic surfactants such as alkylamine salts and quaternary ammonium salts; and amphoteric surfactants such as alkylbetaine, alkylimidazoline derivatives, and alkyldiethylenetriaminoacetic acid. The content of the wetting agent in the electroless displacement gold plating solution of the invention is appropriately determined depending on the composition of the plating solution, the type of the metallic substrate, and the like, and the concentration is generally from $1\times10^{-8}$ to $1\times10^{-2}$ mol/liter, preferably from $1\times10^{-6}$ to $1\times10^{-4}$ mol/liter.

Any gold ion stabilizer for maintaining the stability of the gold ions may be added to the electroless displacement gold plating solution of the invention. The gold ion stabilizer includes but is not limited to cyanides such as potassium cyanide, sodium cyanide, and ammonium cyanide; and substances capable of supplying sulfurous ion such as sodium sulfite, potassium sulfite, and ammonium sulfite. The concentration of the stabilizer in the electroless displacement gold plating solution of the invention can be appropriately determined depending on the content of the gold element at a concentration required for forming the complex or at an excessive content to stabilize the gold complex. The concentration is generally from $2\times10^{-4}$ to 0.5 mol/liter, preferably from $2\times10^{-3}$ to $5\times10^{-3}$ mol/liter.

The additive for use in preparing the electroless displacement gold plating solution of the invention includes a water-soluble silver compound, a water-soluble thallium compound, a water-soluble lead compound, a water-soluble copper compound, or a water-soluble nickel compound. The additive according to the present invention may include one type or two or more types of such water-soluble metal compounds. If two or more types of the water-soluble metal compounds are contained, the respective water-soluble compounds may contain the same metal or different metals.

The electroless displacement gold plating solution according to the present invention can be prepared by adding the additive containing required elements to any electroless displacement gold plating solution. For example, in the case where the additive of the invention contains only the water-soluble silver compound, the additive is added to the electroless displacement gold plating solution to prepare a silver element-containing electroless displacement gold plating solution of the invention. Alternatively, when the additive of the invention contains the water-soluble silver compound and the water-soluble thallium compound, the additive is added to the electroless displacement gold plating solution to prepare an electroless displacement gold plating solution containing the silver and thallium elements. In addition, the silver and thallium containing electroless displacement gold plating solution of the invention can also be prepared by adding two types of the additives of the invention: one including only the water-soluble silver compound; the other including only the thallium water-soluble compound, to any electroless displacement gold plating solution.

The water-soluble gold compound, water-soluble silver compound, water-soluble thallium compound, water-soluble lead compound, water-soluble copper compound, and water-soluble nickel compound usable for the additive of the invention are the same as those described as components of the electroless displacement gold plating solution of the present invention.

When the additive of the invention contains the water-soluble silver compound and the water-soluble thallium compound, a molar ratio of the silver element to the thallium element contained in the additive is in the range of from 1:2000 to 200:1, preferably from 1:50 to 2:1. When the additive of the invention contains the water-soluble silver compound and the water-soluble lead compound, a molar ratio of the silver element to the lead element contained in the additive is in the range of from 1:500 to 2000:1, preferably from 1:5 to 20:1. When the additive of the invention contains the water-soluble silver compound and the water-soluble copper compound, a molar ratio of the silver element to the copper element contained in the additive is in the range of from 1:2000 to 500:1, preferably from 1:20 to 5:1. When the additive of the invention contains the water-soluble silver compound and the water-soluble nickel compound, a molar ratio of the silver element to the nickel element contained in the additive is in the range of from 1:20000 to 50:1, preferably from 1:200 to 2:1. In addition, when the additive of the invention contains the silver element and a plurality of metal elements other than the silver element, each content of the respective metal elements other than the silver element contained in the additive is set within each range for each element as described above.

The additive according to the present invention may further include a complexing agent, a pH stabilizer, a pH adjuster, a wetting agent, or a gold ion stabilizer, or any combination thereof, which are the same as those described as components of the electroless displacement gold plating solution of the invention.

The additive according to the present invention can be in any form, as far as it contains the above-described component(s). Examples of the form include but are not limited to solid, aqueous solution, dispersion, and suspension. Preferably, the additive is in the form of an aqueous solution, because it can easily be mixed with any gold plating solution.

The electroless displacement gold plating solution according to the present invention can be prepared by adding the additive of the invention to any electroless displacement gold plating solution. The additive is added in such an amount that each concentration of the silver element, thallium element, lead element, copper element, nickel element, the complexing agent, and the like fulfills the above-described concentration so as to composing the electroless displacement gold plating solution according to the present invention. Further, any known gold plating solution containing a gold element can be used as an electroless displacement gold plating solution to be added with the additive of the present invention.

The additive according to the present invention is added to any electroless displacement gold plating solution, thereby improving the stability of the electroless displacement gold plating solution. The stability of the plating solution means that, when a gold coating film obtained by plating with a plating solution stored for a certain time period from the preparation of the plating solution is compared with that obtained by plating with a plating solution immediately after the preparation of the plating solution, any one or both of the thickness of the gold plating film and evenness of the plated appearance are maintained. Preferably, the characteristics are maintained even at one week, more preferably one month, and still more preferably one year after the preparation.

Electroless displacement gold plating is performed by treating a metallic substrate with the electroless displacement gold plating solution of the invention, and thereby a gold coating film is formed on a surface of the metallic substrate. The metallic substrate for use in the invention can be formed from any baser metal than gold. The metal may be a metal comprising a gold element solely or an alloy comprising a plurality kinds of metal elements. Examples of the metal for the substrate include but are not limited to metals containing platinum, palladium, lead, silver, rhodium, copper, tin, iron, nickel, indium, cobalt, cadmium, chromium, zinc, aluminum, and titanium elements, and alloys thereof. The metals for use in the metallic substrate of the invention may be metals containing nickel, cobalt, and palladium elements, and alloys thereof. The metallic substrate may be a substrate obtained by thin electroless displacement gold plating to the metallic substrate comprising the above-mentioned metal or metals. Any conventional process can be used as a thin electroless displacement gold plating process, for example, the process is performed by immersing the metallic substrate in any conventional thin electroless displacement gold plating solution.

The metallic substrate of the invention can be in any form. Examples of such a form include but are not limited to plates such as flat plates and curved plates; bars; and balls. The metallic substrate may be processed to have fine structures such as trench and holes. Examples of such substrates can include substrates for electronic parts such as substrates for printed wiring boards and IC cards, ITO substrates, and substrates for ceramic IC packages. It is not necessary that in the metallic substrate of the invention, the whole substrate be constituted of the above-described metal(s). The substrate may comprise a non-metal material such as a ceramic or a resin, and a metal entirely or partially covering the surface of the non-metal material.

The treatment with the electroless displacement gold plating solution of the invention is achieved by bringing the metallic substrate into contact with the plating solution. Any process can be used, as far as it can bring the metallic substrate into contact with the plating solution. A preferred process is immersion of the metallic substrate into the plating solution. The treatment with the plating solution of the invention is carried out at a plating temperature (plating solution temperature) of 50 to 95° C., preferably 60 to 90° C. When a plating temperature is 50° C. or less, the deposition rate of the plated coating is slow so that the productivity is uneconomically low. When a plating temperature is above 95° C., the components in the plating solution may be decomposed. The time period for the plating process in the present invention can be appropriately set depending on the desired thickness of the gold coating film, the metallic substrate used, and the like, being generally 1 to 60 minutes, preferably 10 to 30 minutes.

In case of carrying out the electroless displacement gold plating treatment according to the present invention, stirring of the plating solution is permitted. Batch filtration or circulating filtration may be carried out. Particularly, the plating solution is preferably circulated and filtrated with a filter, so that the temperature of the plating solution can be even, and dusts, precipitates, and the like can be removed from the plating solution. In addition, air may also be introduced into the plating solution, so that the generation of colloidal gold particles or the precipitation of the generated gold particles can effectively be prevented. The introduction of the air may also serves as the agitation of the plating solution with the air. The air may also be blown into the plating solution aside from agitation.

The electroless displacement gold plating solution of the invention has increased stability so that the plating solution used in the electroless displacement gold plating treatment of the invention may be one immediately after the preparation or after a lapse of a certain time period from the preparation. The plating solution is used preferably within one month from the preparation, more preferably within one week from the preparation, and still more preferably immediately after the preparation.

In order to prevent the dilution of the components in the plating solution, any pre-dipping step may be introduced prior to the treatment of the metallic substrate with the gold plating solution of the present invention. The solution for the pre-dipping process herein is an aqueous solution containing the above-mentioned complexing agent and/or the water-soluble metal compound and being free of the gold element.

The electroless displacement gold plating treatment of the invention can provide a metal composite material comprising a metallic substrate and a gold coating film formed on the surface of the metallic substrate. The gold coating film of the metal composite material has a thickness of 0.10 $\mu$m or more, preferably 0.40 $\mu$m or more, and more preferably 0.50 $\mu$m or more. During a certain time period from the start of the plating to the time when the displacement part of the metallic substrate has been consumed, the thickness of the gold coating film increases in accordance with passage of time. As compared with conventional electroless displacement gold plating treatment, the plating treatment using the electroless displacement gold plating solution of the present invention may cause an increase in the coating thickness within a certain time period, namely an increase of a plating rate. For example, with respect to a plating rate in case of using the plating solution of the present invention, an Increase of 0.30 $\mu$m or more in the coating thickness per 30 minutes from the start of the plating, preferably an increase of 0.40 $\mu$m or more in the coating thickness per 30 minutes from the start of the plating, and more preferably an increase of 0.50 $\mu$m or more in the coating thickness per 30 minutes from the start of the plating.

The gold coating film of the metal composite material of the present invention exhibits a even plated appearance. In the present invention, the plated appearance means a result of the visual test according to JIS H 8617 for presence or absence of defects in the plated face. The even plated appearance means that the characteristics such as brightness, dull deposits, and roughness are even in the plated face. An uneven plated appearance means that the plated face is uneven in the characteristics such as brightness, dull deposits, and roughness and has stains, blisters, pits, flaws, or the like.

In the metal composite material of the present invention, an adhesion of the gold coating film to the metallic substrate is improved. The adhesion can be determined by a tape test. The tape test is performed according to ASTM D-3359-95a. Specifically, in the tape test, ten cut lines in each of column and row are made and provide 1 mm square areas with a knife, and a cellophane tape (NICHIBAN CO., LTD., 18 mm in width) is applied to the area and then peeled at a breath, and the peeled squares are counted. The metal composite material of the present invention has preferably no peeled square.

The metal composite material obtained by the treatment of the metallic substrate with the electroless displacement gold plating solution of the invention has a thick gold coating film, exhibits a even plated appearance, and is excellent in adhesion between the gold coating film and the metallic substrate as describer above. Accordingly, adverse effects on the physical properties of the coating such as wire bondability, solder jointability, and solder wettability caused by conventional processes can be reduced. Therefore, the plating method of the present invention is particularly suited for manufacturing electronic parts in which the physical properties of the coating film are required.

The metal composite material of the present invention is prepared by the treatment of the metallic substrate with the electroless displacement gold plating solution containing silver, thallium, lead, copper, or nickel element. In the gold coating film of the composite material, therefore, the silver, thallium, lead, copper, or nickel element is contained. The total content of the silver, thallium, lead, copper, and nickel elements in the gold coating film in the metal composite material of the invention can be 0.5 mol % or less, preferably 0.01 mol % or less, based on the gold element.

EXAMPLES

Examples 1 to 8 described below each provide the electroless displacement gold plating solution according to the present invention, and Comparative Examples 1 to 4 provide electroless displacement gold plating solutions which do not correspond to the present invention. In preparing each plating solution, each compound was dissolved in pure water, and pH was adjusted by potassium hydroxide such that the respective plating solutions had the following compositions. The compounds for each plating solution were reagent grade commercially available chemicals.

Example 1

| | |
|---|---|
| Potassium Dicyanoaurate(I) | 4 g/L (as gold element) |
| Orthophosphoric Acid | 1 mol/L |
| Citric Acid | 0.5 mol/L |
| Patassium Dicyanoargentate(I) | 1 mg/L (as silver element) |
| pH | 6.0 |

Example 2

| | |
|---|---|
| Potassium Dicyanoaurate(I) | 4 g/L (as gold element) |
| Orthophosphoric Acid | 1 mol/L |
| Citric Acid | 0.5 mol/L |
| Silver Oxide | 1 mg/L (as silver element) |
| Thallium Sulfate | 50 mg/L (as thallium element) |
| pH | 6.0 |

Example 3

| | |
|---|---|
| Potassium Dicyanoaurate(I) | 4 g/L (as gold element) |
| Orthophosphoric Acid | 1 mol/L |
| Citric Acid | 0.5 mol/L |

-continued

| | |
|---|---|
| Potassium Silver Cyanide | 1 mg/L (as silver element) |
| Thallium Sulfate | 50 mg/L (as thallium element) |
| pH | 6.0 |

Example 4

| | |
|---|---|
| Potassium Dicyanoaurate(I) | 4 g/L (as gold element) |
| Orthophosphoric Acid | 1 mol/L |
| Citric Acid | 0.5 mol/L |
| Potassium Silver Cyanide | 1 mg/L (as silver element) |
| Lead Nitrate | 1 mg/L (as lead element) |
| pH | 6.0 |

Example 5

| | |
|---|---|
| Potassium Dicyanoaurate(I) | 4 g/L (as gold element) |
| Orthophosphoric Acid | 1 mol/L |
| Citric Acid | 0.5 mol/L |
| Potassium Silver Cyanide | 1 mg/L (as silver element) |
| Copper Nitrate | 1 mg/L (as copper element) |
| pH | 6.0 |

Example 6

| | |
|---|---|
| Potassium Dicyanoaurate(I) | 4 g/L (as gold element) |
| Orthophosphoric Acid | 1 mol/L |
| Citric Acid | 0.5 mol/L |
| Potassium Silver Cyanide | 1 mg/L (as silver element) |
| Nickel Sulfate | 10 mg/L (as nickel element) |
| pH | 6.0 |

Example 7

| | |
|---|---|
| Potassium Dicyanoaurate(I) | 4 g/L (as gold element) |
| Iminodiacetic Acid | 0.5 mol/L |
| Malic Acid | 0.5 mol/L |
| Potassium Silver Cyanide | 1 mg/L (as silver element) |
| Thallium Sulfate | 50 mg/L (as thallium element) |
| pH | 6.0 |

Example 8

| | |
|---|---|
| Sodium Tetrachloroaurate(III) | 4 g/L (as gold element) |
| Orthophosphoric Acid | 1 mol/L |
| Citric Acid | 0.5 mol/L |
| Silver Nitrate | 1 mg/L (as silver element) |
| Thallium Sulfate | 50 mg/L (as thallium element) |
| pH | 6.0 |

Comparative Example 1 (plating solution obtained by removing potassium silver cyanide from that in Example 1)

| | |
|---|---|
| Potassium Dicyanoaurate(I) | 6 g/L |
| Orthophosphoric Acid | 1 mol/L |
| Citric Acid | 0.5 mol/L |
| pH | 6.0 |

Comparative Example 2 (plating solution obtained by removing potassium silver cyanide from that in Example 3)

| | |
|---|---|
| Potassium Dicyanoaurate(I) | 6 g/L |
| Orthophosphoric Acid | 1 mol/L |
| Citric Acid | 0.5 mol/L |
| Thallium Sulfate | 50 mg/L (as thallium element) |
| pH | 6.0 |

Comparative Example 3 (conventional displacement gold plating solution)

| | |
|---|---|
| Potassium Dicyanoaurate(I) | 6 g/L |
| Orthophosphoric Acid | 1 mol/L |
| Ethylenediaminetetraacetic Acid | 0.5 mol/L |
| Thallium Sulfate | 50 mg/L (as thallium element) |
| pH | 4.5 |

Comparative Example 4 (plating solution obtained by removing silver nitrate from that in Example 8)

| | |
|---|---|
| Sodium Tetrachloroaurate(III) | 4 g/L (as gold element) |
| Orthophosphoric Acid | 1 mol/L |
| Citric Acid | 0.5 mol/L |
| Thallium Sulfate | 50 mg/L (as thallium element) |
| pH | 6.0 |

The electroless displacement gold plating treatment of a metallic substrate was carried out as follows.

A 4×4 cm copper plate was electroless plated with nickel about 5 μm in thickness by a conventional process and then thin-plated with gold about 0.03 μm in thickness by displacement plating. The resulting plate was thick-plated with gold by treating it with each electroless displacement gold plating solution of Examples 1 to 8 and Comparative Examples 1 to 4 at 85° C. for 30 minutes. The resulting test piece thick-plated with gold by displacement plating was measured for the thickness of the gold coating film with a fluorescent X-ray microthicknessmeter (Seiko Instruments Inc.). The test piece thick-plated with gold by displacement plating was also visually observed for its appearance according to JIS H 8617. Each electroless displacement gold plating solution of Examples 1 to 8 and Comparative Examples 1 to 4 was used immediately after the preparation and one week after the preparation. The results are shown in Table 1.

TABLE 1

Results of thickness measurement of displacement gold plating deposition and results of plated appearance observation

| | Immediately After Preparation | | One Week After Preparation | |
|---|---|---|---|---|
| Type of Bath | Deposited Gold Thickness (μm) | Plated Appearance | Deposited Gold Thickness (μm) | Plated Appearance |
| Example 1 | 0.457 | even | 0.448 | even |
| Example 2 | 0.466 | even | 0.456 | even |
| Example 3 | 0.404 | even | 0.412 | even |
| Example 4 | 0.444 | even | 0.455 | even |
| Example 5 | 0.439 | even | 0.447 | even |
| Example 6 | 0.460 | even | 0.470 | even |
| Example 7 | 0.501 | even | 0.512 | even |
| Example 8 | 0.401 | even | 0.408 | even |
| Comparative Example 1 | 0.173 | even | 0.134 | even |
| Comparative Example 2 | 0.303 | even | 0.252 | uneven |
| Comparative Example 3 | 0.422 | even | 0.301 | uneven |
| Comparative Example 4 | 0.210 | uneven | 0.167 | uneven |

As shown in Table 1, when the plating solutions of Examples 1 to 8 which are the electroless displacement gold plating solution according to the present invention are used, even one week after the preparation as well as immediately after the preparation, a even plated appearance can be exhibited, and the thickness of each gold coating film is 0.40 μm or more. Therefore, it is found that a sufficiently thick-plated gold plating is possible and the stability of the plating solution is excellent. On the contrary, in Comparative Examples 1 to 4 in which the electroless displacement gold plating solution of the invention is not used, both of a even plated appearance and a sufficient thickness of the gold coating film can not be obtained at the same time. In particular, one week after the preparation of the plating solution, a even plated appearance and a sufficient thickness of the gold coating film can not be obtained. Therefore it is found that the stability of the plating solution is insufficient.

Industrial Applicability

As described above, the electroless displacement gold plating solution according to the present invention contains a predetermined amount of a silver element or a combination of a silver element and at least one element selected from thallium, lead, copper, and nickel. This provides advantages that, in a gold coating film of a metal composite material obtained by treating a metallic substrate with the plating solution, a plated appearance is even, a thickness of the gold coating film is sufficient, a plating speed is high, an adhesion of the gold coating film to the undercoat metal is excellent, and further there is no adverse effect on the properties of the coating such as wire bondability, solder jointability, and solder wettability. Further, the electroless displacement gold plating solution of the invention has an excellent stability so that the plating treatment is possible regardless of time after the preparation. In addition, the additive containing silver element and/or thallium, lead, copper, or nickel element, which should be contained in the electroless displacement gold plating solution, at a predetermined content facilitates the preparation of the electroless displacement gold plating solution.

What is claimed is:

1. An electroless displacement gold plating solution comprising:

1) at least one water-soluble gold compound providing from $5\times10^{-4}$ to $5\times10^{-2}$ mol/liter of a gold element;

2) 0.01 to 2.0 mol/liter of at least one complexing agent; and 3) at least one water-soluble silver compound providing from $1\times10^{-6}$ to $1\times10^{-3}$ mol/liter of a silver element.

2. The electroless displacement gold plating solution according to claim 1, further comprising a water-soluble metal compound selected from the group consisting of at least one water-soluble thallium compound providing from $5\times10^{-6}$ to $2\times10^{-3}$ mol/liter of a thallium element, at least one water-soluble lead compound providing from $5\times10^{-7}$ to $5\times10^{-4}$ mol/liter of a lead element content, at least one water-soluble copper compound providing from $2\times10^{-6}$ to $2\times10^{-3}$mol/liter of a copper element, at least one water-soluble nickel compound providing from $2\times10^{-5}$ to $2\times10^{-2}$ mol/liter of a nickel element, and combinations thereof.

3. The electroless displacement gold plating solution according to claim 2, wherein a molar ratio of the silver element to the thallium element is in the range of from 1:2000 to 200:1, a molar ratio of the silver element to the lead element is in the range of from 1:500 to 2000:1, a molar ratio of the silver element to the copper element is in the range of from 1:2000 to 500:1, and a molar ratio of the silver element to the nickel element is in the range of from 1:20000 to 50:1.

4. The electroless displacement gold plating solution of claim 1, wherein the solution has a pH of 10.0 or less.

5. An additive for use in preparing the electroless displacement gold plating solution of claim 1, comprising a water-soluble silver compound, a water-soluble thallium compound, a water-soluble lead compound, a water-soluble copper compound, or a water-soluble nickel compound, or any combination thereof.

6. An additive for use in preparing the electroless displacement gold plating solution of claim 2, comprising a water-soluble silver compound and a water-soluble metal compound, wherein the water-soluble metal compound is selected from the group consisting of a water-soluble thallium compound, a water-soluble lead compound, a water-soluble copper compound, a water-soluble nickel compound, and combinations thereof, and in the additive, a molar ratio of the silver element to the thallium element is in the range of from 1:2000 to 200:1 molar ratio of the silver element to the lead element is in the range of from 1:500 to 2000:1, a molar ratio of the silver element to the copper element is in the range of from 1:2000 to 500:1, and a molar ratio of the silver element to the nickel element is in the range of from 1:20000 to 50:1.

7. The additive for use in preparing the electroless displacement gold plating solution of claim 5, further comprising a complexing agent, a pH stabilizer, a pH adjuster, a wetting agent, or a gold ion stabilizer, or any combination thereof.

8. An electroless displacement gold plating method, comprising treating a metallic substrate with the electroless displacement gold plating solution of claim 1.

9. The electroless displacement gold plating method according to claim 8, wherein the metallic substrate is thin-plated with gold by displacement plating.

10. A metal composite material prepared by the method of claim 8, having a gold coating film on a surface of the metallic substrate.

11. The metal composite material according to claim 10, wherein the gold coating film has a thickness of 0.40 $\mu$m or more.

12. A method for stabilizing an electroless displacement gold plating solution, comprising: adding the additive for use in preparing the electroless displacement gold plating solution of claim 5 to an electroless displacement gold plating solution.

* * * * *